US009555646B1

(12) United States Patent
Gibb et al.

(10) Patent No.: US 9,555,646 B1
(45) Date of Patent: Jan. 31, 2017

(54) METHODS AND APPARATUS FOR PRINTING ON A THREE DIMENSIONAL OBJECT

(71) Applicant: Homegrown For Good, LLC, New Rochelle, NY (US)

(72) Inventors: Thomas Gibb, New York, NY (US); Timothy Gibb, Hoboken, NJ (US)

(73) Assignee: Homegrown For Good, LLC, New Rochelle, NY (US)

( * ) Notice: Subject to any disclaimer, the term of this patent is extended or adjusted under 35 U.S.C. 154(b) by 0 days.

(21) Appl. No.: 15/042,844

(22) Filed: Feb. 12, 2016

Related U.S. Application Data

(60) Provisional application No. 62/117,356, filed on Feb. 17, 2015.

(51) Int. Cl.
*B41J 3/407* (2006.01)

(52) U.S. Cl.
CPC ..... *B41J 3/4073* (2013.01)

(58) Field of Classification Search
CPC ..... B41J 3/4073
See application file for complete search history.

(56) References Cited

U.S. PATENT DOCUMENTS 5,090,320 A * 2/1992 Nave ..... B41F 15/0895 101/126
8,168,257 B2 * 5/2012 Lambert ..... A43D 8/22 264/132
2013/0323415 A1 * 12/2013 Brackley ..... B41M 5/007 427/171

* cited by examiner

*Primary Examiner* — Manish S Shah
*Assistant Examiner* — Yaovi M Ameh
(74) *Attorney, Agent, or Firm* — Sunstein Kann Murphy & Timbers LLP

(57) ABSTRACT

An apparatus and method are provided for printing high resolution images on a surface that exhibits varying levels of thickness and/or elevation. One application of the method and apparatus of this invention is the printing of images on footwear, such as flip-flops or sandals.

17 Claims, 12 Drawing Sheets

METHODS AND APPARATUS FOR PRINTING ON A THREE DIMENSIONAL OBJECT

CROSS REFERENCE TO RELATED APPLICATIONS

The present application claims the benefit of U.S. Provisional Patent Application No. 62/117,356, filed Feb. 17, 2015, the disclosure of which is incorporated by reference herein in its entirety.

BACKGROUND

Challenges may arise when using a printer to print high resolution images on non-uniform or uneven surfaces of three-dimensional objects. This is particularly true for ink jet printers. Such printers often require a maximum and/or a minimum, generally uniform, spacing between a printing head and the surface of an object on which an image is to be printed.

One example of a three dimensional object is the base of an open-toed sandal or flip-flop or other casual footwear. Flip-flops include a relatively thin sole that, when worn, is loosely held on to the foot by a strap that extends between two toes (e.g., big toe and second toe) and around either side of the foot, or a strap that extends over the top of the foot. The base of conventional flip-flops is typically made of rubber or ethylene-vinyl acetate (EVA). Flip-flop bases are typically die cast into a large sheet which is cut into appropriately-shaped base portions. Flip-flops may have a raised portion on the base adjacent the location of the arch to provide support for the arch when worn.

Screen printing has been used to apply images to the surfaces of flip-flops. Screen printing involves the use of an ink blocking stencil that is placed over the surface of the flip-flop on which the image is to be received. The stencil provides open areas through which ink and/or other printable substances may pass. A tool, such as a fill blade or squeegee is pressed against the stencil, pushing ink through the openings to form the design on the surface of the flip-flop. Such screen printed images are low resolution. Difficulty has been encountered in attempting to print high resolution images on surfaces of flip-flops, in part because of the raised arch support and/or other irregularities on the surface.

SUMMARY

The present disclosure relates to an apparatus and method for printing high-resolution images on a surface that exhibits varying levels of thickness and/or elevation. The apparatus and method of the present disclosure may be useful in a variety of applications, such as printing images on footwear. Flip-flops or sandals having a molded base may be stylized with a high-resolution image printed on the upper surface of the base. Such molded articles of footwear may be inclined, textured or may otherwise exhibit variations in thickness and/or elevation due to protrusions, recesses, inclines, arch supports and the like, making it challenging to print high-resolution images thereon.

In some embodiments, an object (e.g., base of a flip-flop, sandal, other footwear, etc.) may be manipulated so that a printing surface thereof, such as a surface facing upwardly toward a printing head, is made substantially flat and/or planar, where a difference between a maximum elevation and a minimum elevation of the printing surface may be less than about 3 mm or 5 mm. In some embodiments, an apparatus for manipulating the object may be a tool such as a jig that includes a substrate having a receptacle for receiving the object such that the printing surface of the object faces outwardly from the substrate. A retaining member, such as a plate, bar, insert and/or other support part may be used to deflect or otherwise manipulate at least a portion of the printing surface of the object to be suitably flat. When the surface is sufficiently flat, ink may be appropriately deposited from one or more nozzles of a printing head (e.g., a high-resolution ink jet printer) onto the surface on which a desired image is to be printed.

In an illustrative embodiment, a method of printing an image on a printing surface of a three-dimensional object facing a printing head is provided. The method may include manipulating the object so that the printing surface of the object is substantially flat such that a difference between a maximum elevation and a minimum elevation of the printing surface is less than about 5 mm. The method may also include depositing ink from the printing head on the substantially flat printing surface of the object.

In another illustrative embodiment, an apparatus for facilitating printing of an image on a printing surface of a three-dimensional object is provided. The apparatus may include a substrate including at least one receptacle for receiving the object such that the printing surface of the object faces outwardly from the substrate. The apparatus may also include at least one retaining member constructed and arranged to deflect a portion of the object so that the printing surface is substantially flat such that a difference between a maximum elevation and a minimum elevation of the printing surface is less than about 5 mm.

Various embodiments of the present disclosure provide certain advantages. Not all embodiments of the present disclosure share the same advantages and those that do may not share them under all circumstances. Various embodiments described may be used in combination and may provide additive benefits.

Further features and advantages of the present disclosure, as well as the structure of various embodiments of the present disclosure are described in detail below with reference to the accompanying figures.

BRIEF DESCRIPTION OF FIGURES

The accompanying figures are not intended to be to scale. For purposes of clarity, not every component may be labeled in every figure. Various embodiments of the present disclosure will now be described, by way of example, with reference to the accompanying figures, in which.

DETAILED DESCRIPTION

The present disclosure relates to a system and method for printing high-resolution images/designs onto a surface of a three dimensional object, such as an article of footwear (e.g., flip-flop, sandal, liner, etc.). In certain embodiments, various portions of the object may be deflected, pushed, pressed against or otherwise manipulated so that the printing surface of the object, the surface facing the printing head, is substantially flat. As provided herein, a substantially flat surface may be a surface that is substantially planar to allow a printing head to automatically travel over the surface and deposit ink in a manner that produces a desired design or image on the printing surface, at high-resolution and without noticeable distortion. In addition, in one embodiment, the printing surface may be substantially equally spaced from the printing head along substantially the entire length and width of the printing surface.

Figure 1A:
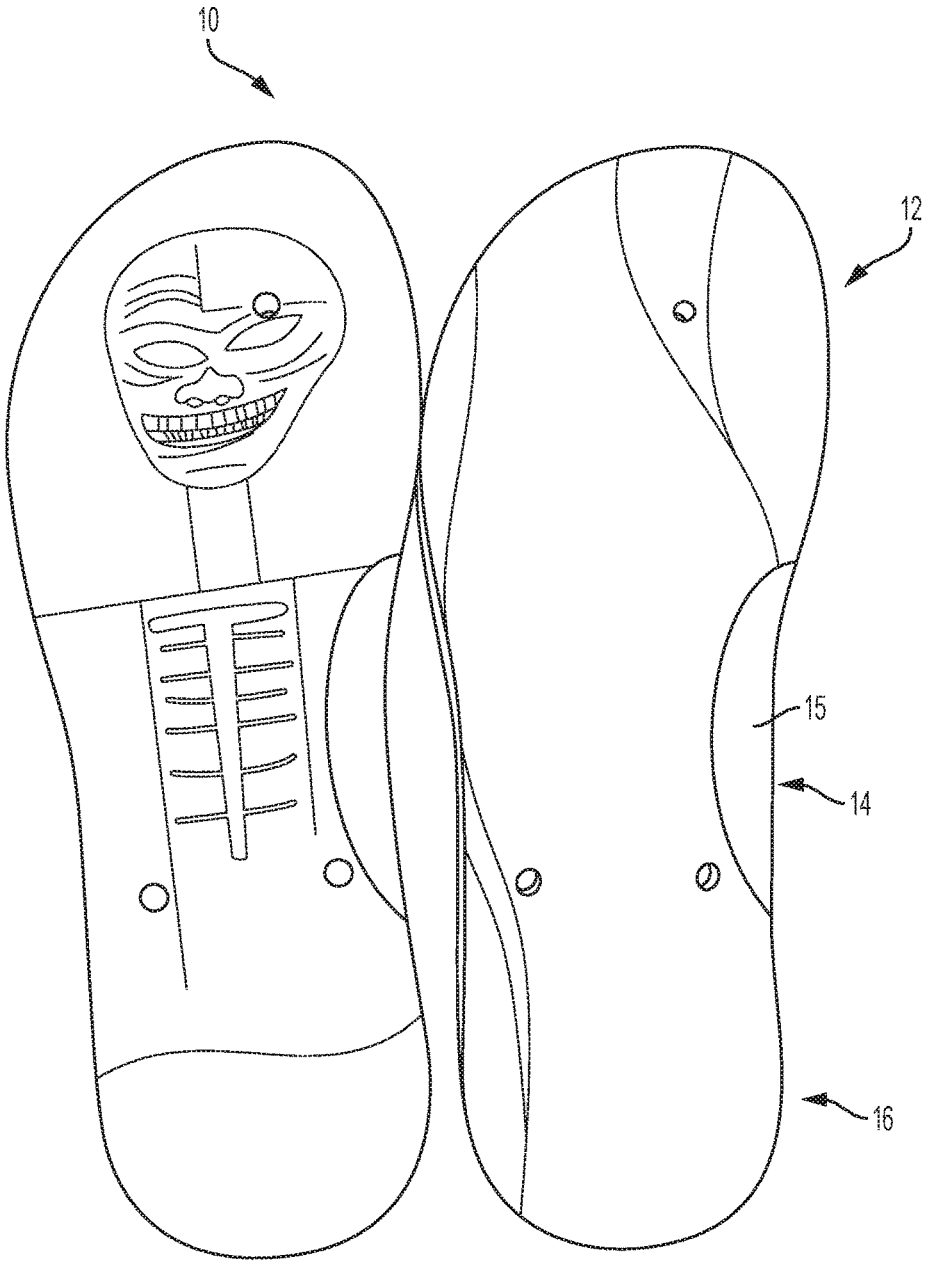
FIG. 1A is a top plan view of footwear objects having an image printed thereon in accordance with some embodiments.
Figure 1B:
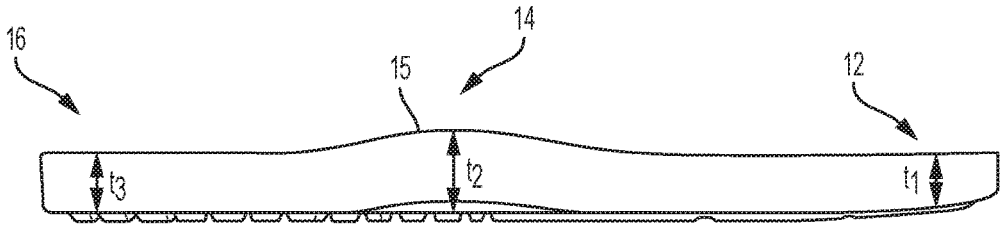
FIG. 1B is a rear side elevational view of one of the footwear objects of FIG. 1A.

FIGS. 1A-1B illustrate flip-flop bases 10 on which a high-resolution image has been printed. The base 10 may be made of molded polyurethane, having a structure that provides a desirable degree of comfort and support for the wearer. The base 10 has a front region 12, a middle region 14 and a rear region 16. In this embodiment, the middle region 14 includes a raised arch-support 15 which is a protrusion that may provide a wearer of the flip-flop with a suitable degree of added arch support during use.

As shown in FIG. 1B, different regions of the flip-flop base 10 may have varying thicknesses and, thus, varying elevations. For instance, the front region 12 of the base may have a thickness $t_1$; the raised arch-support 15 at the middle region 14 of the base may have a thickness $t_2$, and the rear region 16 of the base may have a thickness $t_3$. For various embodiments, each of the thicknesses $t_1$, $t_2$, $t_3$ may be similar or different. In this embodiment, the thickness $t_2$ of the raised arch-support 15 at the middle region 14 is greater than each of the thicknesses $t_1$ and $t_3$, although it can be appreciated that the thickness of other portions of the middle region 14 may be less than the thickness $t_2$ at the raised arch-support. For example, portions of the middle region 14 other than the raised arch-support may have a thickness that is less than the thickness $t_2$.

Also, in this embodiment, the thickness $t_3$ at the rear region 16 is greater than the thickness $t_1$ at the front region 12. Thus, when placed on a flat surface, the upper surface of the flip-flop base 10 may exhibit a slight incline downwardly from the rear toward the front region. The base 10 also may be have a curved structure such that the front and rear regions are displaced upwardly or downwardly relative to the middle region. It can be appreciated that various portions of the flip-flop base may have any suitable shape or contour.

As discussed herein, to print an image on a printing surface 11 facing a printing head at a high-resolution, it may be desirable for the printing surface 11 that receives the image to be substantially flat or planar and to be spaced from the printing substantially the same distance over its entire surface. That is, the printing surface should be sufficiently planar and equally spaced from the printing head for the printer to deposit ink in a fashion that produces a suitable image within the operating parameters (such as focal distance) of the printer.

Figure 2A:
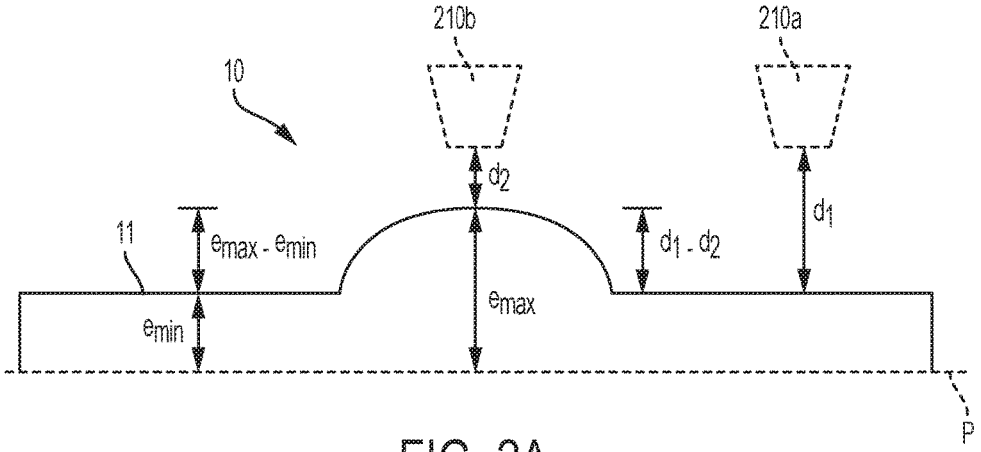
FIG. 2A is a schematic diagram depicting a cross-section of an object in accordance with some embodiments.

In considering whether the printing surface 11 is sufficiently planar for high-resolution printing thereon, the difference between the maximum elevation and the minimum elevation of the printing surface may fall within an appropriate range. As provided herein, and schematically shown in FIG. 2A, when an object 10 having a printing surface 11 is placed on a surface defining a reference plane P, so that the printing surface 11 faces away from the reference plane P and toward the printing head, the minimum elevation $e_{min}$ of the printing surface 11 is the distance measured in a direction perpendicular to the reference plane P from the reference plane P to the lowest point on the printing surface 11 (i.e., the point closest to the reference plane P), and the maximum elevation $e_{max}$ is the distance measured in a direction perpendicular to the reference plane P from the reference plane P to the highest point on the printing surface 11 (i.e., the point farthest from the reference plane P). The difference between the maximum elevation and the minimum elevation, $e_{max}-e_{min}$ may then be determined.

Figure 2B:
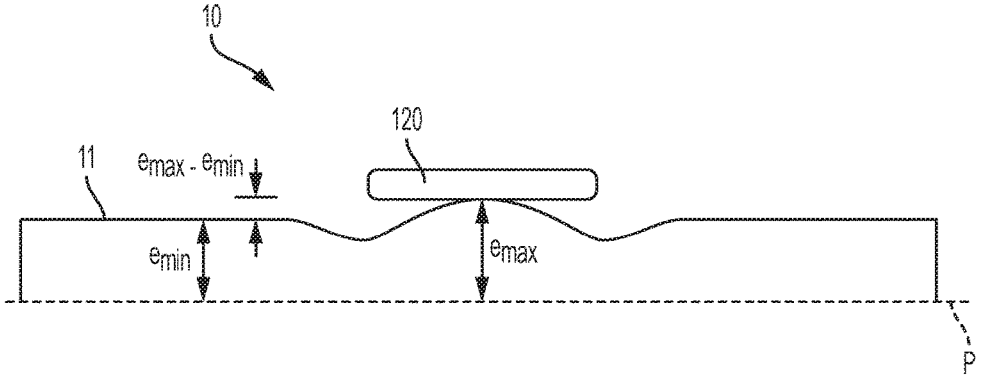
FIG. 2B is a schematic diagram depicting a cross-section of the object of FIG. 2A with a portion compressed.

The printing surface 11 may be compressed, deflected or otherwise manipulated so as to provide a difference between the maximum elevation $e_{max}$ of the printing surface and the minimum elevation $e_{min}$ of the printing surface 11 to achieve a sufficiently planar printing surface 11. For example, as shown in FIG. 2B, a plate 120, or other tool such as a bar, may be used to compress the raised portion of the printing surface downwardly so that the difference between the maximum elevation $e_{max}$ and the minimum elevation $e_{min}$ is reduced. In some embodiments, the difference between the maximum elevation $e_{max}$ of the printing surface and the minimum elevation $e_{min}$ of the printing surface may be about 1 mm, about 2 mm, about 3 mm, about 4 mm, about 5 mm, about 6 mm, about 7 mm, about 8 mm, about 9 mm, about 10 mm, or about 12 mm; or less than about 15 mm, less than about 12 mm, less than about 10 mm, less than about 9 mm, less than about 8 mm, less than about 7 mm, less than about 6 mm, less than about 5 mm (e.g., between about 1 mm and about 5 mm), less than about 4 mm (e.g., between about 2 mm and about 4 mm), less than about 3 mm, less than about 2 mm, or less than about 1 mm. For various embodiments, values outside of these ranges may be possible.

It can be appreciated that the distance between the printing head and the printing surface 11 at one point on the printing surface 11 may be greater or less than the distance between the printing head and the printing surface 11 at another point on the printing surface. For example, as further shown in FIG. 2A, the printing head 210*a* at one point during printing may be spaced from the printing surface 11 by a distance $d_1$, and the printing head 210*b* at another point during printing may be spaced from the printing surface 11 by a distance $d_2$. In accordance with aspects of the present disclosure, it may be preferable for the difference in spacing $d_1-d_2$ between the printing head and the printing surface 11 at all points on the printing surface 11 to fall within a suitable range to result in a high-resolution image.

In various embodiments, the difference in spacing $d_1-d_2$ between a first distance $d_1$ between the printing head 210*a* and the lowest point on the printing surface 11 and a second distance $d_2$ between the printing head 210*b* and the highest point on the printing surface 11 may be no greater than about 1 mm, no greater than about 2 mm, no greater than about 3 mm, no greater than about 4 mm, no greater than about 5 mm, no greater than about 6 mm, no greater than about 7 mm, no greater than about 8 mm, no greater than about 9 mm, or no greater than about 10 mm. Or, for various embodiments, the range of distances between the printing head and printing surface may be between about 1 mm and about 10 mm, between about 1 mm and about 5 mm, or between about 2 mm and about 4 mm. In a preferred embodiment, the range of distances between the printing head 210 and printing surface 11 during printing is no greater than about 3 mm. For various embodiments, values outside of these ranges may be possible.

For some embodiments, as the printing head travels over the printing surface, the entirety, or at least a significant portion, of the printing surface 11 may be kept within a desired range of distances from the printing head 210. For example, the ink exiting from the nozzle(s) of the printing head may be focused such that the distance between the printing head 210 and the printing surface 11 of the object is kept within a preferred range throughout the printing process. By keeping the distance between the printing head 210 and the printing surface 11 of the object within the preferred focal range, the ink may be applied to the printing surface 11 in a manner that results in a high-resolution, high-quality image. It may also be desirable for the distance between the printing head 210 and the printing surface 11 to be sufficient so as to allow for proper clearance of the printing head 210 over the printing surface 11 of the object.

Suitable distances between the printing head 210 and the printing surface 11 of the object may be about 1 mm, about 2 mm, about 3 mm, about 4 mm, about 5 mm, about 6 mm, about 7 mm, about 8 mm, about 9 mm, about 10 mm, or about 12 mm; or less than about 15 mm, less than about 12 mm, less than about 10 mm, less than about 9 mm, less than about 8 mm, less than about 7 mm, less than about 6 mm, less than about 5 mm, less than about 4 mm, less than about 3 mm, less than about 2 mm, or less than about 1 mm. For various embodiments, values outside of these ranges may be possible.

Figure 3:
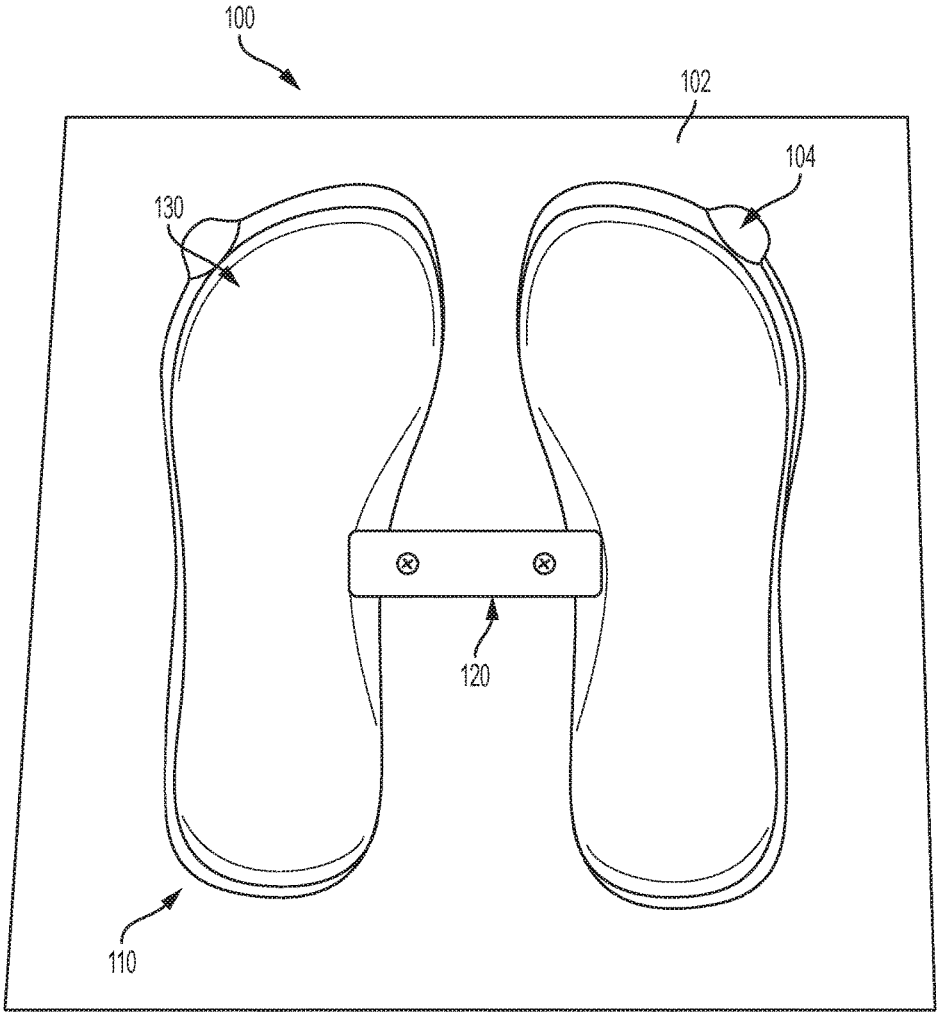
FIG. 3 is a top view of a tool in accordance with some embodiments.
Figure 4:
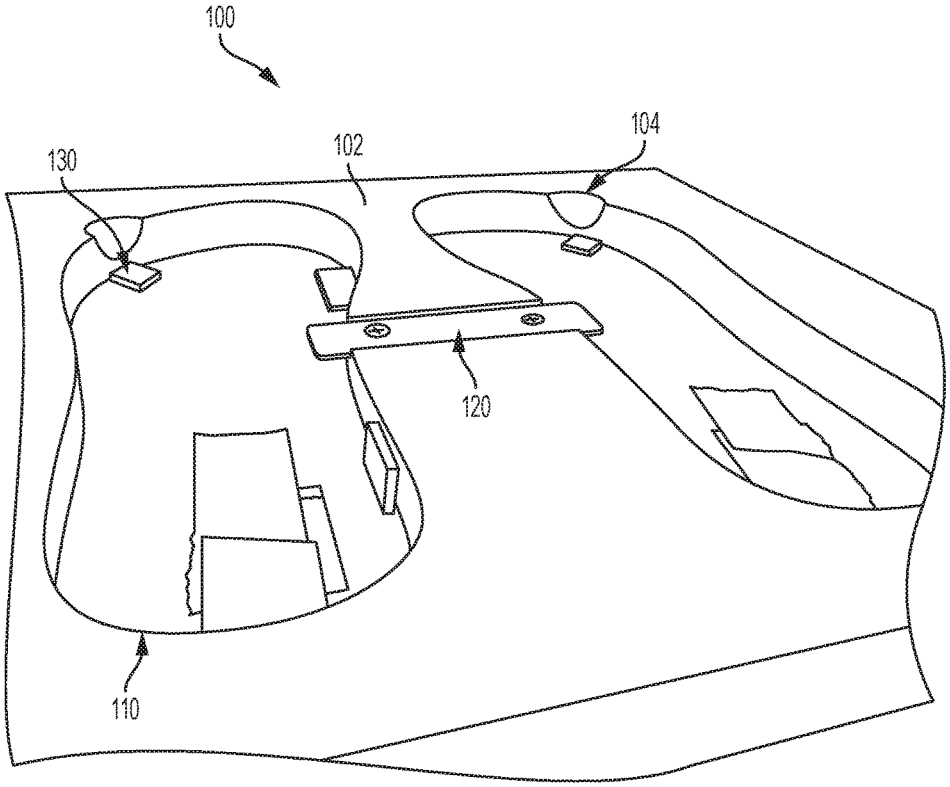
FIG. 4 is a top perspective view of the tool of FIG. 3.
Figure 5:
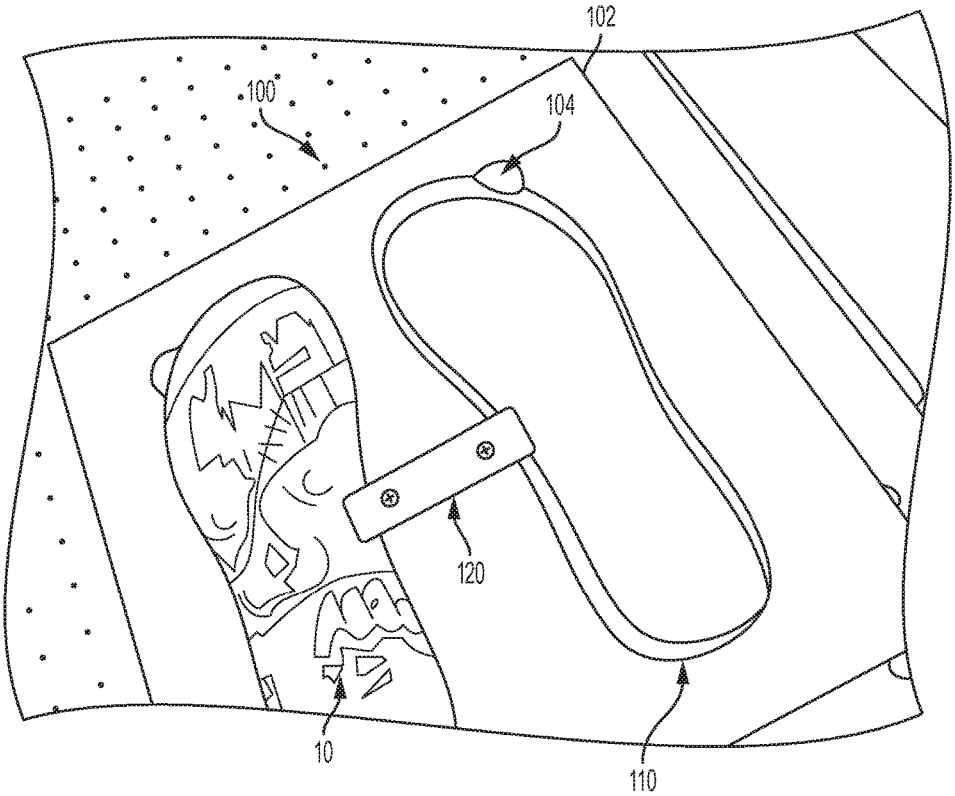
FIG. 5 is a top perspective view of the tool of FIG. 3 and a footwear object in accordance with some embodiments.

FIGS. 3-5 depict an embodiment of a tool 100 which is a jig for controlling the location and structure of the base 10 during printing. The tool 100 may be used to compress, deform, raise, tilt or otherwise manipulate and hold appropriate portions of the base 10 so that the printing surface is sufficiently flat or level.

The tool 100 may include a substrate 102 that includes receptacles 110 for receiving correspondingly shaped flip-flop bases 10. The substrate 102 may also have one or more recesses 104 that allow a user to easily remove material from the receptacle 110. For example, when a material such as a flip-flop base 10 is inserted or placed into a corresponding receptacle 110, to remove the base 10, a user may insert a small tool or finger into a recess 104 so as to pry the material from the receptacle.

The tool 100 may further include one or more retaining members for compressing or deflecting a portion of the base 10 so that the printing surface (e.g., upper surface) of the base 10 is substantially planar. The retaining member(s) may be used to deflect the base upwardly, downwardly, or in any other appropriate direction so as to present the printing surface in a manner that is suitable for high-resolution printing. It can be appreciated that any suitable retaining member(s) may be used in any appropriate arrangement.

The retaining member(s) may include one or more plates or bars 120. The plate 120 depicted in this embodiment may be used for downwardly deflecting a portion (e.g., the arch-support 15) of the base 10. For instance, as shown in FIG. 4, when a flip-flop base 10 is inserted into the receptacle 110, the plate 120 may downwardly compress the otherwise raised arch-support 15 by pressing there against, and hold the arch-support in place. As a result, the arch-support 15 of the object, when compressed downwardly, does not interfere with the printing head as it closely travels over the surface of the base during printing. In some embodiments, as shown in FIG. 4, the plate 120 may reside within a recess of the upper surface of the jig. As shown, the recess may be deep enough for the plate 120 to be positioned so that the arch-support is held down sufficiently during printing and so that the plate 120 itself does not interfere with movement of the printing head. In some cases, the upper surface of the plate 120 may be positioned below the upper surface of the jig.

Other retaining member(s) may include one or more inserts 130. The inserts 130, or spacers, may be used for upwardly deflecting a portion (e.g., front region 12) of the base 10. The inserts 130 may be used to compensate for any natural incline of the upper printing surface 11 of the base 10, or for pushing a portion of the base 10 upwardly. For example, if the upper surface of the base 10 exhibits a natural incline downwardly from the rear region 16 toward the front region 12, the insert 130 may be placed at the front of the receptacle so as to deflect the front region 12 of the base upwardly, resulting in a substantially flat upper surface upon which the printer may suitably deposit ink for printing a high-resolution image thereon. If the base 10 has a natural curved structure where both the front region 12 and the rear region 16 dip slightly downwardly, multiple inserts may be placed at the front and rear of the receptacle, at suitable locations, to provide appropriate deflection of the front and rear regions 12 and 16 upwardly, also resulting in a substantially planar printing surface 11.

In some embodiments, the receptacle may include an inclined surface that counteracts any natural incline of the base 10. For example, if the base 10 is constructed such that the printing surface 11 inclines downwardly from the rear region 16 toward the front region 12, the surface of the receptacle 110 may be inclined upwardly from the rear region 16 toward the front region 12 such that when the base 10 is placed within the receptacle 110, the upper printing surface 11 has no substantial incline. Or, at least, the difference between the maximum and minimum elevations of the printing surface remains within a desired range.

Figure 6:
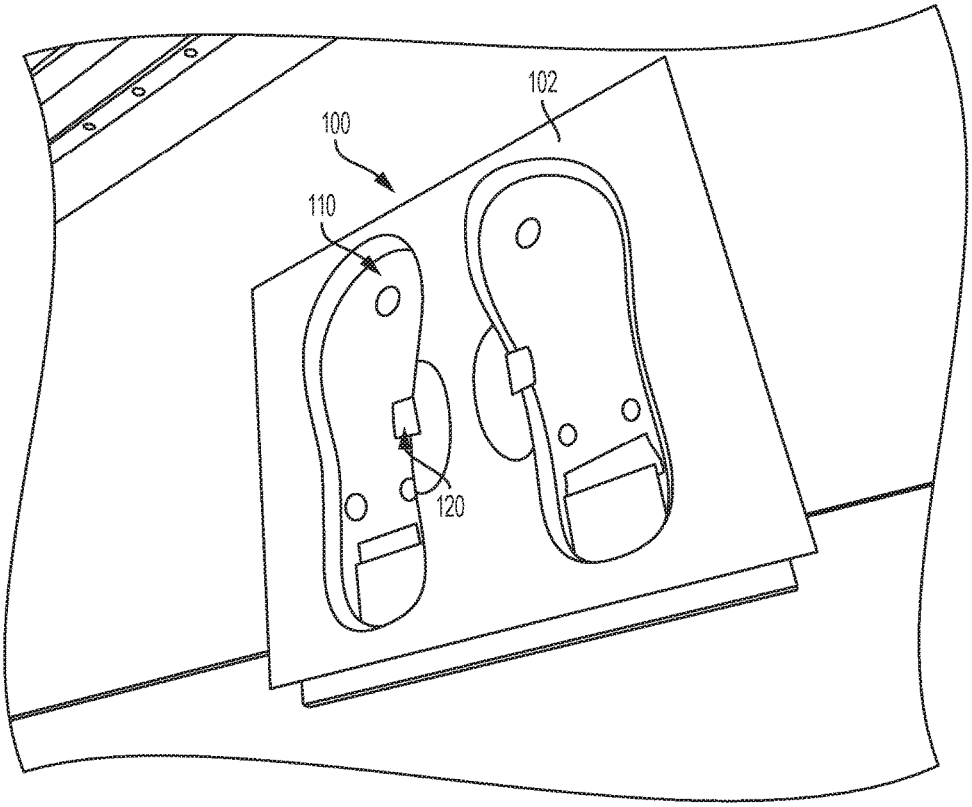
FIG. 6 is a top perspective view of another tool in accordance with some embodiments.

FIG. 6 shows another embodiment of a tool 100 having a substrate including receptacles 110 for receiving appropriately sized bases of footwear, such as for flip-flops. The tool 100 also includes retaining plates 120 for compressing the raised arch-support 15 of the base 10 when suitably positioned within the receptacle(s). In this example, a separate plate 120 may be associated with each receptacle, rather than a single plate extending across multiple receptacles. The retaining plates 120 may exhibit any suitable shape, such as a hooked or L-shape. In various embodiments, an anchoring portion of the plate (not expressly shown) may be directly secured to the substrate and another compressing portion of the plate overhangs respective receptacles 110. When the base of a flip-flop having a raised arch-support is inserted into the receptacle 110, then the overhanging portion of the retaining plate 120 may serve to compress the corresponding raised arch-support (which would otherwise protrude upwardly) downwardly so that the surface of the base remains substantially planar. Hence, it can be appreciated that the tool may employ any appropriate retaining member in any suitable configuration.

Figure 7:
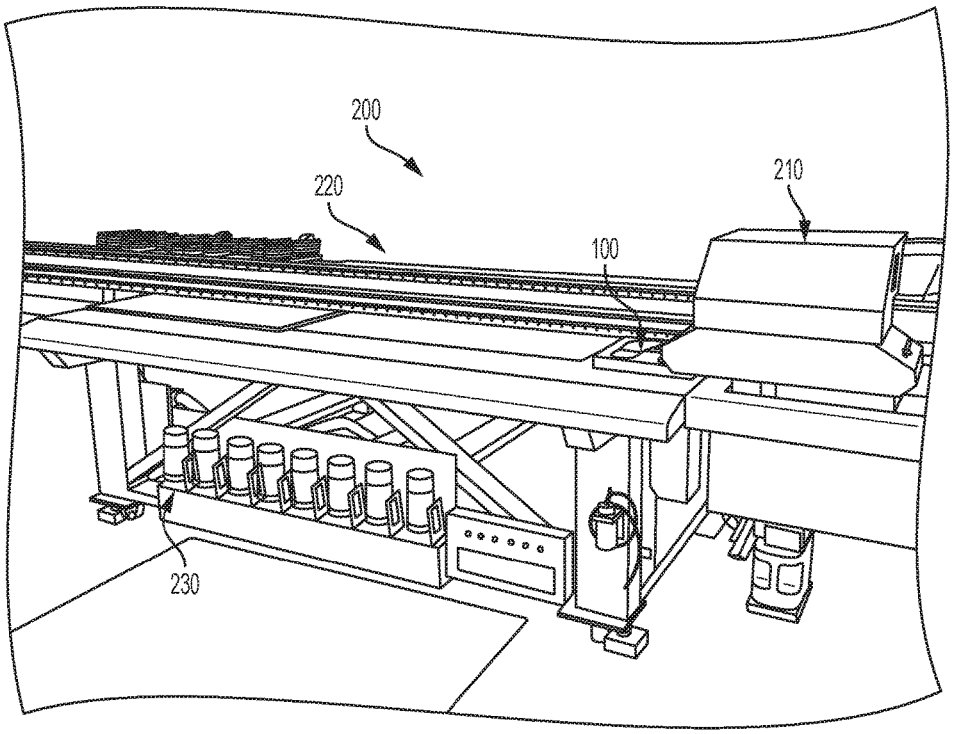
FIG. 7 is perspective view of a printing system in accordance with some embodiments.
Figure 8:
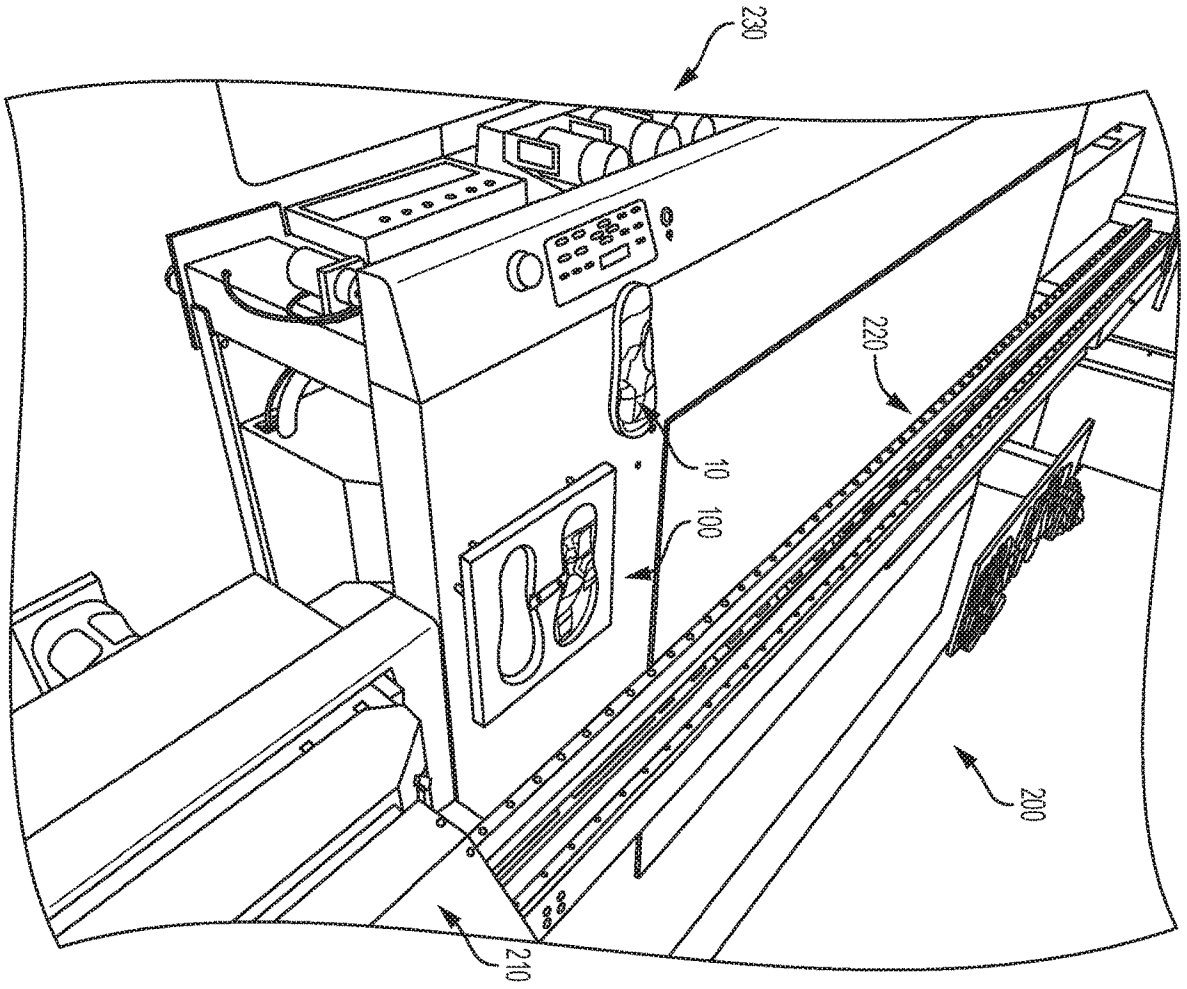
FIG. 8 is a top perspective view of a printing system of FIG. 7 showing a tool and footwear objects in accordance with some embodiments.
Figure 9:
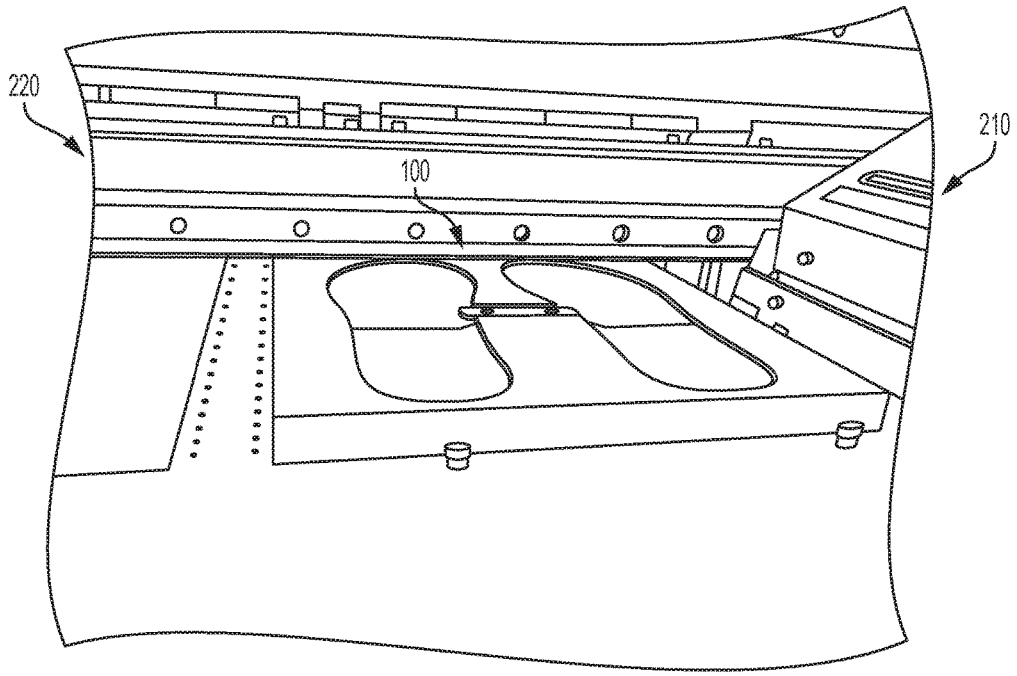
FIG. 9 is side perspective view of the printing system having the tool and footwear objects of FIG. 8.

FIGS. 7-9 depict a printing system 200 that may be used in cooperation with the tool 100, for printing high-resolution images on the printing surface 11 of the base 10. In this embodiment, the printing system 200 is a JFX200-2513 provided by Mimaki Engineering Co. In certain cases, for producing high-resolution images using this system, the range of distances between the printing head 210 and the printing surface 211 over the entire printing surface 211 during printing may be kept to no greater than about 3 mm. It can be appreciated that any suitable printer and/or printing system may be employed for embodiments of the present disclosure.

As shown in FIGS. 7-9, the printing system 200 includes a printing head 210 and rails 220 upon which the printing head 210 may travel in a first, or x-direction. The printing head 210 includes nozzles (not expressly shown in the figures) through which ink, supplied by reservoirs 230, may be appropriately deposited. As further shown, the tool 100, with one or more suitably molded bases 10, is positioned to receive the ink from the printing head 210. While only one tool 100 is shown in FIGS. 7-9, it can be appreciated that multiple tools 100, each holding respective bases 10, may be placed in a suitable arrangement (e.g., side-by-side, grid, etc.) such that the printer may print onto the upper surfaces of each of the bases at the same time, providing for suitable scaling of the printing.

Figure 10:
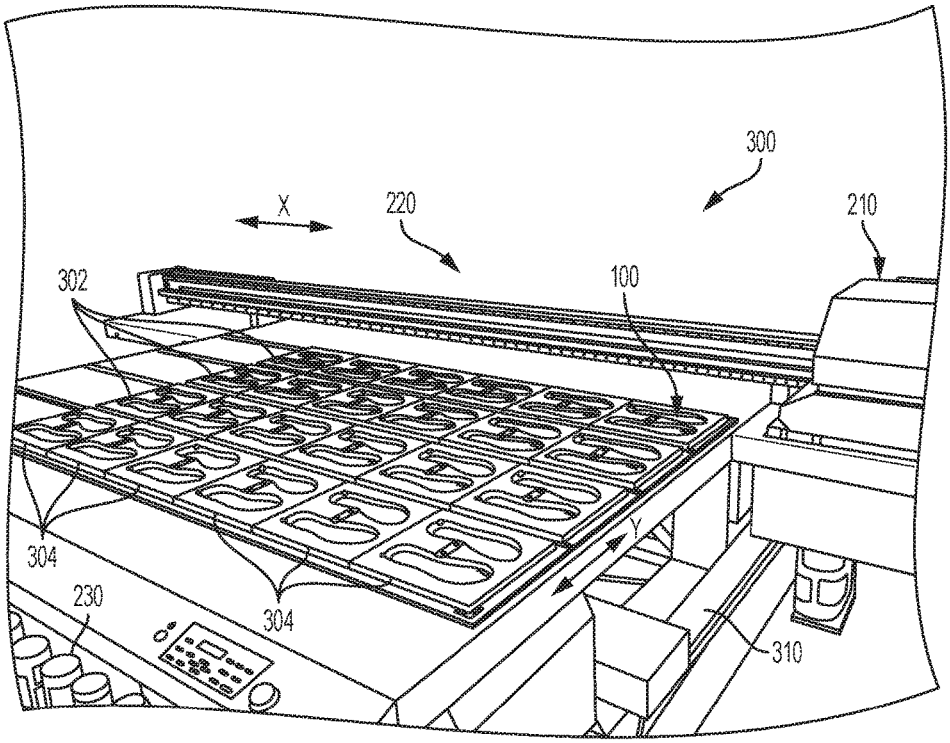
FIG. 10 is a top perspective view of another embodiment of the printing system of FIG. 7.

An embodiment of a printing system 300 of this invention having multiple tools 100 in a grid arrangement is shown in FIG. 10. Printing system 300, like printing system 200, includes rails 220 along which head 210 may travel in a first or x-direction. In system 300, tools 100 with respective bases 10 may be placed in a grid. In the non-limiting example illustrated in FIG. 10, the grid may include four rows 302 of tools in the one or x direction and six columns 304 of tools in a second orthogonal or y-direction. Head 210, along with rails 220 also may travel in the second, or y-direction orthogonal to the one or x-direction along rails 310. In one example of the operation of the system 300, head 210 may first travel in the x-direction and print onto all of the printing surfaces 11 of bases 10 along one row 302. Thereafter head 210 and rails 220 may be indexed in the y-direction along rails 310 to be aligned with another row 302. Thereafter, all of the printing surfaces of bases 10 in that row are printed In various embodiments, a number of parameters may be input into the printing system 200, including a digital image to be printed on to the printing surface 11 of the base 10 and the location of the base 10 to receive the printed image. Once the appropriate parameters are input, the printing system 200 may then automatically move the printing head 210 over the base 10 so as to deposit ink on to the printing surface 11 of the base 10. When fully deposited, the ink may form a high-resolution image on the surface of the base 10. In some embodiments, the system 200 may move the printing head 210 over the base 10 and deposit ink on the printing surface 11 in a back and forth raster-type arrangement, or other type of pattern.

The bases 10 of the flip-flops may be manufactured according to any suitable technique. As discussed above, the bases may be cut from a large die cast sheet. Alternatively, for some embodiments, such as those discussed herein, the base 10 may be made via a molding process. In such instances, an appropriately tailored composition, such as a polymer (e.g., polyurethane and/or other polymer, co-polymer) may be poured into a mold and allowed to solidify into a low density, lightweight, structurally resilient foam.

Once the base 10 is formed and appropriately solidified within the mold, a mold releasing agent may be applied to the base 10 to ease removal of the base from the mold. In some cases, the presence of the mold releasing agent on the base 10 may interfere with the ability of the ink to bond to the base. Thus, before printing, the base 10 may be treated with a solvent (e.g., a silicone based solvent), which may be effective to remove the mold releasing agent from the base 10, or neutralize certain effects of the mold releasing agent. Once the mold releasing agent is sufficiently removed, an adhesion promoter may be applied to the base 10, to facilitate bonding of the ink to the printing surface 11 of the base 10.

Having thus described several aspects of at least one embodiment of the present disclosure, it is to be appreciated various alterations, modifications, and improvements will readily occur to those skilled in the art. For example, the devices described herein may be adapted for use in footwear or non-footwear related applications. Such alterations, modification, and improvements are intended to be part of this disclosure, and are intended to be within the spirit and scope of the present disclosure. Accordingly, the foregoing description and figures are by way of example only.

What is claimed is:

1. A method of printing an image with a printing head on a printing surface of a base of an article of footwear, wherein the base includes a first region, a middle region and a second region, the middle region being disposed between the first and second regions, wherein the middle region includes a portion that is raised with respect to the printing surface of the base, and wherein a thickness of the second region of the base is greater than a thickness of the first region of the base, the method comprising:

depressing the raised portion against the printing surface of the middle region of the base so that the raised portion extends less than about 5 mm above the printing surface of the base;

tilting the first region of the base with respect to the second region of the base toward the printing head so that the printing head is spaced approximately the same distance from the printing surface in the first region and in the second region of the base; and depositing ink from the printing head on the printing surface of the first region, the middle region and the second region of the base.

2. The method of claim 1, wherein depressing the raised portion causes the raised portion to extend above the printing surface less than 3 mm.

3. The method of claim 1, further comprising placing the base of the item of footwear within a receptacle of a substrate such that the printing surface of the base faces away from the substrate.

4. The method of claim 1, wherein depressing the raised portion includes using at least one retaining member compress the raised portion to cause the printing surface to be substantially flat.

5. The method of claim 1, wherein tilting the first region of the base includes positioning at least one insert under the first region of the base.

6. The method of claim 1, wherein tilting the first region of the base includes placing the base on an inclined surface of the receptacle.

7. The method of claim 1, wherein depositing ink from the printing head includes inputting at least one of a digital image and a location of the base to a printing system to result in automatic positioning of the printing head over the base and printing of the image on the printing surface of the base.

8. The method of claim 7, wherein depositing ink from the printing head includes raster printing the image on the printing surface of the base.

9. The method of claim 1, wherein the article of footwear includes at least a part of a flip flop or sandal.

10. Apparatus for printing an image on a printing surface of a base of an article of footwear, the base comprising a first region, a second region, a middle region, and a printing surface disposed on the first, middle and second regions, the middle region being disposed between the first and second regions of the base, wherein a thickness of the second region of the base is greater than a thickness of the first region of the base, the apparatus comprising:

a printing head; a substrate including at least one receptacle for receiving the base of the article of footwear such that the printing surface of the first, middle and second regions faces outwardly away from the substrate and toward the printing head;

at least one retaining member constructed and arranged to depress downwardly toward the printing surface of the middle region a raised portion disposed on the printing surface of the middle region so that the raised portion extends above the printing surface of the middle region less than about 5 mm;

at least one insert disposed in the receptacle for upwardly deflecting one of the first and second regions of the base with respect to the other of the first and second regions toward the printing head a distance such that the printing surface of the first region and the printing surface of the second region are both spaced approximately the same distance from the printing head.

11. The apparatus of claim 10, wherein the at least one receptacle is shaped to receive the article of footwear.

12. The apparatus of claim 11, wherein the at least one receptacle is shaped to receive at least a part of a flip flop or sandal.

13. The apparatus of claim 10, wherein the at least one retaining member is constructed and arranged to depress the raised portion so that the raised portion extends above the printing surface less than about 3 mm.

14. The apparatus of claim 10, wherein the at least one retaining member is constructed and arranged to be placed against the raised portion to maintain the printing surface to be substantially flat.

15. The apparatus of claim 14, wherein the at least one retaining member includes at least one plate constructed and arranged to extend across the middle region to downwardly depress the raised portion of the base.

16. The apparatus of claim 10, wherein the at least one insert includes an inclined surface in the receptacle.

17. The apparatus of claim 10 wherein the distance from the printing head to the printing surfaces of the first and second regions is less than about 5 mm.

* * * * *